US005385103A

United States Patent [19]

Juvik-Woods

[11] Patent Number: 5,385,103

[45] Date of Patent: Jan. 31, 1995

[54] ADAPTOR FOR FOUR-WAY PAPER CARGO PALLET

[75] Inventor: Harry C. Juvik-Woods, San Rafael, Calif.

[73] Assignee: Damage Prevention Products, Inc., Benecia, Calif.

[21] Appl. No.: 76,733

[22] Filed: Jun. 14, 1993

[51] Int. Cl.[6] ..... B65D 19/00

[52] U.S. Cl. ..... 108/51.3; 108/56.3

[58] Field of Search ..... 100/51.3, 51.1, 56.1, 100/56.3

[56] References Cited

U.S. PATENT DOCUMENTS

| | | | |
|---|---|---|---|
| 2,446,914 | 8/1948 | Fallert et al. | 108/51.3 |
| 4,119,205 | 10/1978 | Delany | 108/56.3 X |
| 5,076,176 | 12/1991 | Clasen | 108/51.3 |
| 5,121,696 | 6/1992 | Harder | 108/51.3 |

FOREIGN PATENT DOCUMENTS

| | | | |
|---|---|---|---|
| 2490187 | 3/1982 | France | 108/51.3 |
| 9212061 | 7/1992 | WIPO | 108/51.3 |

*Primary Examiner*—Jose V. Chen
*Attorney, Agent, or Firm*—E. Thomas Wheelock

[57] ABSTRACT

This invention is an adaptor to convert a paper pallet from a two way entry design to a four way entry design. The pallet with the adaptor might be used to support cargo during that cargo's transportation or storage and is typically constructed of paper. The pallet design onto which the adaptor is placed typically involves a central platform or deck constructed of a honeycomb filler bounded on the bottom surfaces by a corrugated sheet. Runners or legs are included to support the central platform. The adaptor is, in turn, fit onto the bottom of the pallet and separates the runners from the floor in such a way that a forklift or other materials handling device may reach the beneath the pallet from any of four different directions. The adaptor is constructed from a series of honeycomb cores bounded on their bottom and sides by a single folded sheet of corrugate.

12 Claims, 3 Drawing Sheets

ADAPTOR FOR FOUR-WAY PAPER CARGO PALLET

FIELD OF THE INVENTION

This invention is an adaptor to convert a paper pallet from a two way entry design to a four way entry design. The pallet with the adaptor may be used to support cargo during that cargo's transportation or storage and is typically constructed of paper. The pallet design onto which the adaptor is placed typically involves a central platform or deck constructed of a honeycomb filler bounded on the bottom surfaces by a corrugated sheet. Runners or legs are included to support the central platform. The adaptor is, in turn, fitted onto the bottom of the pallet and separates the runners from the floor in such a way that a forklift or other materials-handling device may reach the beneath the pallet from any of four different directions. The adaptor is constructed from a series of honeycomb cores bounded on their bottom and sides by a single folded sheet of corrugate.

BACKGROUND OF THE INVENTION

A pallet is a portable, horizontal, rigid, platform used as a base for assembling, storing, stacking, handling goods as a unit load. Conventional pallets are typically constructed of wood and are made by stapling or nailing a number of boards (known as "deckboards") at their ends to a number of continuous solid boards (known as "stringers"). The upper set and lower set (where used) of deckboards thereby form an open area defined by the thickness of the stringers. This opening is used to accommodate a fork lift or hand truck. In this way the pallet may be moved from place to place by lifting the pallet and its load off the floor.

The vast majority of all pallets used in the U.S. are constructed of wood, but wood pallets have many disadvantages. Labor and material costs for wooden pallets have increased faster than inflation. Because of their expense, the pallets are often reused or returned to their place of origin. The cost of returning empty pallets to their owners is obviously high. Additionally, The average weight of a wooden pallet is about forty pounds. Since shipping costs are usually tied to the weight of the goods shipped, the cost of shipping is increased by the weight of the pallet. Indeed, pallets are sufficiently heavy that smaller warehouse workers are able manually to move the pallets only with some difficulty. Wooden pallets are often damaged during use and, because of the pallet cost, must be repaired if possible or disposed of. Depending upon the industry involved, pallets may be used between two and four times before they are disposed of. Disposal of any solid materials including broken pallets is an increasingly difficult and costly problem.

My invention is an adaptor allowing a paper pallet which has been constructed as a two-way pallet to be used as a four-way entry pallet. The two-way pallets are typically constructed of paper and have a central platform or deck constructed of a honeycomb filler bounded on the bottom surface by a continuous corrugated sheet which covers the supporting legs or runners so to form a continuous cover over the entire bottom surface. The upper surface of the central platform may be covered with a corrugated sheet or heavy paper stock. Additionally, the upper and/or lower sheets may be folded over the edges of the honeycomb core and fastened to the other side. Runners or legs are included to support the central platform.

The adaptor is simple in design and is constructed from a series of honeycomb cores bounded on their bottom and sides by a single folded sheet of corrugate.

In addition to the inherent strength and low cost of my designs, by careful selection of construction materials, they may be completely recycled as paper without separation into constituent parts.

There are a number of pallet designs which are made mostly of paper. For instance, U.S. Pat. No. 3,661,099, to Shelor, shows a paper shipping pallet having a deck having a core section made of small strips cut from single, double, or triple wall corrugated paper board sheet stock glued face to face. Sheets of corrugated are glued to the longitudinal edges of the composite core. The core and facing sheets are desirably of a specific size of corrugated sheets, i.e., having a size "A" flute or better. The legs of the pallet appear to be wooden blocks.

U.S. Pat. No. 3,650,459, to Tucker, shows a paper pallet design involving a folded corrugate sheet as the cargo support area. That cargo deck is provided with a number of pallet feet (which operate as spacer blocks within the cargo deck) made of molded plastic material such as polystyrene. The use of a honeycomb core within the cargo support area is not disclosed.

U.S. Pat. No. 3,952,672, to Gordon et al, shows a disposable pallet made of a single folded corrugated sheet. The use of a honeycomb core on the cargo support area is not disclosed.

U.S. Pat. Nos. 4,867,074 and 5,001,991, to Smith, each show a pallet design in which the cargo deck is made up of a large number of girders folded from corrugated sheet and assembled with a series of cross girders. The use of a honeycomb core in the cargo support area is not disclosed.

U.S. Pat. No. 4,790,249, to Webb, shows a pallet design in which the cargo deck is made up of facing sheets separated by a number of blocks having a specific design. The block design involves a cellulosic material glued together by a bonding material (such as ureaformaldehyde) all extruded into the shape of a box beam. The boxes are positioned so to protect the deck from the tines on a fork lift.

Netherlands Patent Application 83-00024 shows an interesting design for a paper pallet. The cargo support deck appears to be constructed of a number of loops of paper glued together at a number of sites within the deck and also glued to a periphery forming the edge of the deck. Neither the use of a honeycomb core nor the use of corrugated sheet in the cargo deck support area is disclosed.

There are few disclosures showing the use of honeycomb materials in the core of the cargo support deck.

One such disclosure is Published U.K. Patent Application 2,213,462-A to Green et al. This published application shows a paper pallet design in which the cargo deck is made up of two face sheets of, e.g., corrugated cardboard and having a an open structure such as a paper or card honeycomb between them. It is said that the deck may be raised from the floor using feet of similar construction. The deck core is made to be penetrable by the tines of a fork lift.

U.S. Pat. No. 4,319,530, to Moog, discloses a pallet, said to be disposable, having a cargo supporting deck area made up of a central core of a honeycomb made of laminated corrugate. The core is faced with one or more corrugated sheets glued to the core. The facing on the cargo support surface of the central core may be made up of multiple layers of corrugated sheets.

None of these disclosures show an adaptor suitable for converting a two-way paper pallet into a four-way entry pallet.

SUMMARY OF THE INVENTION

In general, this invention is an adaptor for use change a paper two-way entry pallet into a four-way entry pallet. The typical two-way pallet design involves a central platform constructed of a honeycomb filler, the upper surface of which may be bounded by corrugate or paper or other suitable covering. The lower surface of the pallet's central platform often is bounded by a single sheet of folded corrugate and has longitudinal runners or legs, particularly those utilizing honeycomb or corrugate cores and corrugate skins. The skin may overlap up onto the edges of the central platform.

The adaptor is a series of honeycomb blocks of an appropriate size which are covered on their lower and side portions by a folded sheet of corrugate. The corrugate may have tabs which extend up onto the longitudinal runners to provide a glue surface for mounting the adaptor.

Although the invention may be made of a variety of materials, I prefer to construct it from materials which may be readily recycled using commercially available technology.-For instance, the various sheet material is desirably of kraft paper or other similar paper stock. Of course, depending upon the service into which the pallet is placed, other materials may be selected, e.g., MYLAR, polyethylene, polypropylene (clear or fibrous paper product), or the like is acceptable. Some thermosetting polymeric materials are not currently widely recyclable and may not be the best of choices from that viewpoint. Choice of materials and methods to join together the various components of the adaptor and the pallet may also be made on the basis of recyclability. For instance, most water-based glues, e.g., hide glue, mucilage, etc. are glues compatible with the kraft paper recycling processes. Heat sealing thermoplastic materials such as polypropylene is an expedient using no adhesive.

Figure 1B:
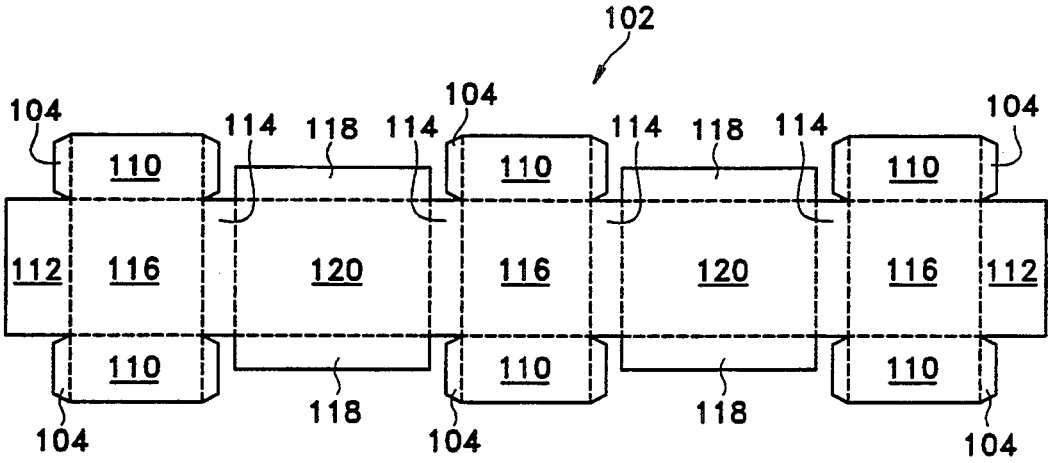
FIG. 1B shows a plan diagram of the lower sheet used in the FIG. 1A configuration.
Figure 1A:
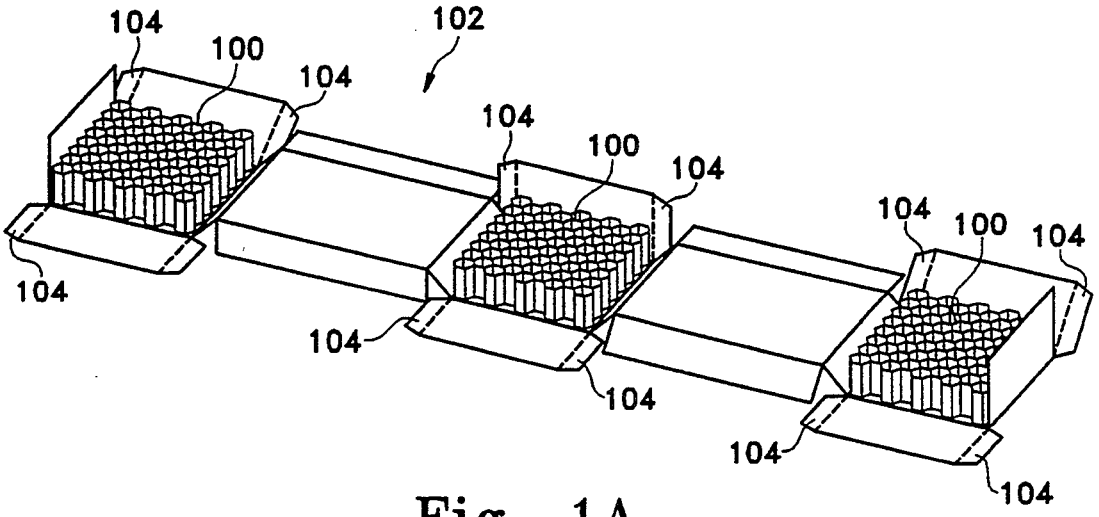
FIG. 1A is an exploded drawing of the components of an adaptor made according to the invention.

FIG. 1A is an exploded diagram showing the components of the basic configuration of the invention. In this configuration, there are three core blocks (100) each comprising an expanded honeycomb material. Joined to these cores on their lower face is a lower facing sheet (102). The facing sheet preferably is of a corrugate or other suitable material such as paper. The lower corrugated facing sheet (102) adheres to the bottomsides and, as folded for use, extends upwardly up to cover the sides of the cores and therefore encloses all but the top side of the core blocks (100). It also has tabs (104) which may be folded over and allow it to adhere variously to the adjacent sheet covering the side of the core block and the sides of the runners on the pallet. If the method for joining the various sheets to the honeycomb cores is properly carried out or if commercially available honeycomb stock is used, the cells within the core are sealed and therefore isolated from each other. The core strength is enhanced by these closed cells and imparts an amount of springiness and shock absorbing capabilities to the core.

FIG. 1B shows a plan view of the bottom facing sheet (102). The long tabs (110) extending from the long side of the lower sheet (102) fold over the sides of the core blocks (100) and further up onto the edge of the cores (100) as is shown in FIG. 1A. Similarly, the end tabs (112) fold over the end side of the end set of cores (100) and farther up onto the runner of the paper pallet as will be shown in more detail below. The smaller tabs (104) shown on the FIG. 1B lower facing sheet (102) are all folded over the adjacent edge when folded as depicted in FIG. 1A. The tabs are all glued to the sheet to which they are attached. Intermediate sections (114) fold onto the sides of the core blocks (100 in FIG. 1A). Sections (106) adhere to the bottom of the core blocks (100 in FIG. 1A). Tabs (118) are folded upwardly to meet and adhere to the sides of the runners on the paper pallet. Sections (120) adhere to the bottom surface of the runners on the paper pallet.

Figure 2:
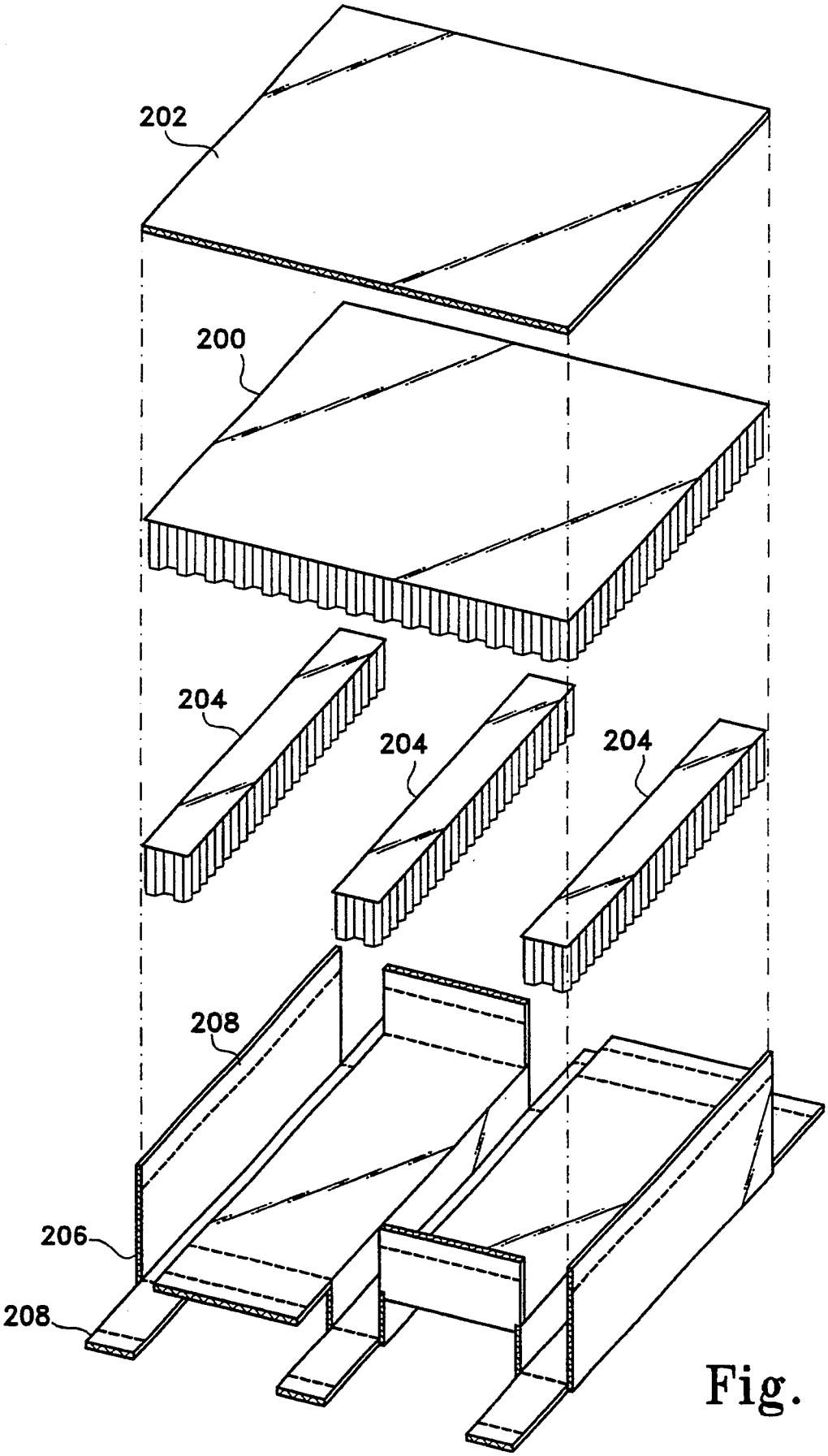
FIG. 2 is an exploded drawing of the components of a typical two-way entry paper pallet using runners to support the cargo deck.

FIG. 2 is an exploded diagram of the components of a typical two-way paper pallet suitable for use with the adaptor of this invention. In this configuration, the central core (200) comprises an expanded honeycomb material, Joined to this core on the upper face of the core is a facing sheet (202). The facing sheet may be of a corrugate or a sheet of a suitable material such as paper, This variation of the pallet uses a lower corrugate sheet which is integrated with the runners supporting the core (200) to enhance the overall strength of the pallet. The runners and the lower deck facing are made of a set of runner cores (204) of expanded honeycomb or multilaminate corrugate and a lower folded corrugate sheet (206). The runners are separated from each other on the lower face of the core and cover at least a portion of that lower face. They run from one edge of the deck transversely to the opposite edge. The lower corrugated folded sheet (206) adheres to and encloses the runner core blocks (204). It also has tabs (208) which may be folded over and allow it to adhere to the cargo (or upper) surface of the upper face (202).

It may be desirable to include a glue sheet (210) between runner core blocks (210) and core deck (200). Although it is not required, the glue sheet may provide an enhanced surface to allow both better adhesive junctions between the two adjacent honeycomb blocks and closure of the cells in the honeycombs. As with the cores in the inventive adaptor, if the joining of the various sheets to the core is properly carried out, the cells within the core are sealed and therefore impart an amount of springiness and shock absorbing capabilities to the core. The runners obviously cannot be separated from the deck without the virtually complete destruction of the pallet.

If the upper facing sheet (202) is a corrugate sheet, the flutes in the respective corrugated sheets (202, 206) should be positioned such that the flutes in sheet (202) are not parallel to the flutes in sheet (206). The angle between the respective flutes may between about 0° and 90°, preferably between 30° and 90°, although for a very practical pallet from the vantage of strength, versatility, and ease of construction, an included angle between the flutes of about 90° is desirable.

Figure 3A:
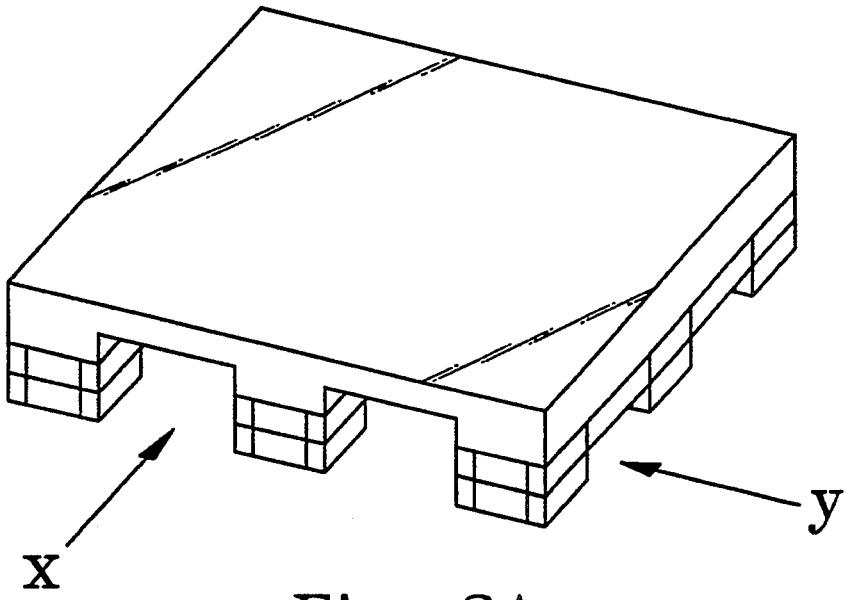
FIGS. 3A and 3B are, respectively, top and bottom perspective views of the inventive adaptor installed on a pallet.
Figure 3B:
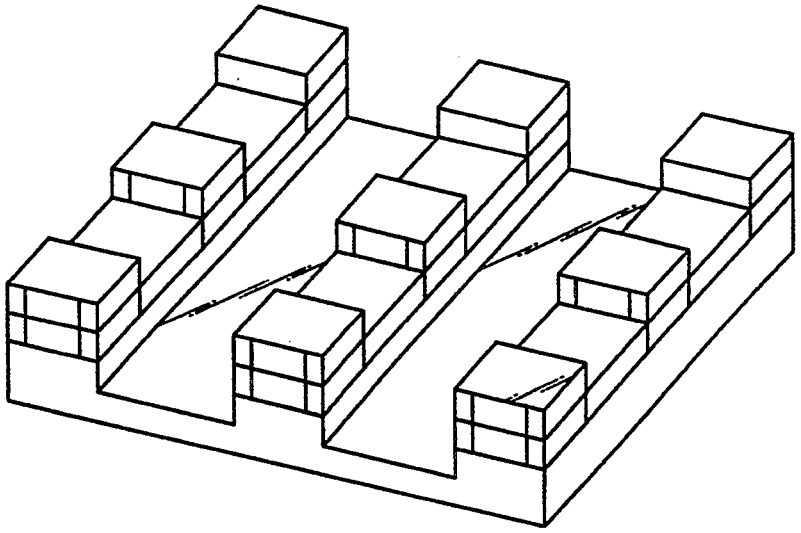

FIGS. 3A and 3B are, respectively, top and bottom perspective views of three of the inventive adaptors applied to a single paper two-way pallet. The wide slots between the runners on the underside of the cargo deck permit entry of forklift or hand truck tines from either of opposite ends (the "x" direction in FIG. 4A). The adaptors allow those tines to enter from the orthogonal direction (the "y" direction in FIG. 4A).

This invention is not limited to the basic variation shown in the figures. Additional sheets of corrugated material may be added to the upper and lower faces of the combination shown in FIG. 4A and 4B if additional strength is needed for some particular purpose. Addition of a sheet on the upper (or load-bearing face) is preferable to enhance the impact resistance of the pallet deck. The combination of adaptor and pallet may be coated with a material which will harden or waterproof or dustproof the pallet. These materials may be chosen to meet whatever criteria are appropriate for the pallet use. For instance, if used in a humid atmosphere or used outside or are moved between refrigerated and nonrefrigerated areas, waterproofing is desirable. Known water-based and oil-based materials may be applied as needed.

Additionally, the cargo face of the deck may be covered with or coated with a suitable material to prevent slippage of the cargo.

When the adaptor of this invention is used in conjunction with roller conveyer systems, a hard sheet material such as paperboard, Masonite, plywood, hardened corrugate, etc. may be glued to the bottom of the runners. The hard sheet material is desirably one-fourth to one-half inch in thickness. The paperboard is made from thin sheets of paper glued and compressed together to give a hard surface to the bottom of the runners. The hard surface prevents the bottom of the adaptor cores from depressing around the conveyer roller and thereby preventing the load-bearing pallet form rolling easily down the conveyer. The hard paperboard provides adequate hardness for reducing the compressibility of the bottom and therefore reduces drag on the pallet combination.

The invention has been described by description and by example. The examples are just examples and are not to be used to limit the scope of the invention in any way. Additionally, one having ordinary skill in this art will recognize variations and equivalents within the invention as described which will not necessarily be within the scope of the appended claims.

I claim as my invention:

1. An adaptor for converting a two-way entry cargo pallet having a first set of slots to accept tines of a forklift and longitudinal runners having a bottom and sides and supporting a cargo surface, to a four-way entry pallet comprising:

multiple support blocks each having a top, sides, and a bottom and separated from each other to provide a second set of slots substantially perpendicular to said first set of slots and each said support block adhesively attached to a single lower facing sheet, said lower facing sheet comprising a corrugated sheet adherent to the multiple support blocks and folded to cover the bottoms of each of the support blocks and to extend upwardly from the bottoms of said support blocks and to cover the sides of the support blocks and is there folded to extend between adjacent support blocks and to provide a surface to allow adhesive attachment to said cargo pallet longitudinal runner bottom between the multiple support blocks.

2. The adaptor of claim I including three support blocks.

3. The adaptor of claim 1 wherein the multiple support blocks comprise honeycomb.

4. The adaptor of claim 3 where a substantial portion of cells within the honeycomb support blocks are sealed.

5. The adaptor of claim 1 where the composition of one or more of the multiple support blocks and lower facing sheets is selected from paper, MYLAR, polyethylene, polypropylene (clear or fibrous paper product).

6. The adaptor of claim 5 where the composition of one or more of the multiple support blocks and lower facing sheets is paper.

7. A four-way entry pallet comprising in combination:

a two-way entry cargo pallet having a first set of slots to accept tines of a forklift and multiple longitudinal runners, each said runner having a bottom and sides and each said runner being situated beneath and supporting a cargo deck, an adaptor associated with and adhering to each said runner, each said adaptor comprising multiple support blocks and a single lower facing sheet, wherein said a) multiple support blocks each having a top, sides, and a bottom and separated from each other and the bottom of each adhesively attached to said single lower facing sheet and to longitudinal pallet runner, and b) said single lower facing sheet for each said adaptor comprising a corrugated sheet adherent to the multiple support blocks and folded to cover the bottoms of each of the support blocks and to extend upwardly from the bottoms of said. support blocks and to cover the sides of the support blocks and is there folded to extend between adjacent support blocks and to allow adhesive attachment to said cargo pallet longitudinal runner bottom between the multiple support blocks.

8. The pallet of claim 7 including three support blocks per pallet longitudinal runner.

9. The pallet of claim 7 wherein the multiple support blocks comprise honeycomb.

10. The pallet of claim 7 where the composition of one or more of the multiple support blocks and lower facing sheets is selected from paper, MYLAR, polyethylene, polypropylene (clear or fibrous paper product).

11. The pallet of claim 10 where the composition of one or more of the multiple support blocks and lower facing sheets is paper.

12. The adaptor of claim 10 where a substantial portion of cells within the honeycomb support blocks are sealed.

* * * * *